United States Patent [19]

Körner et al.

[11] 4,438,308

[45] Mar. 20, 1984

[54] PUFFER PISTON CIRCUIT BREAKER

[75] Inventors: Gerhard Körner, Schriesheim; Volker Rees, Darmstadt, both of Fed. Rep. of Germany

[73] Assignee: BBC Brown, Boveri & Company, Limited, Baden, Switzerland

[21] Appl. No.: 257,709

[22] Filed: Apr. 27, 1981

[30] Foreign Application Priority Data

Apr. 25, 1980 [DE] Fed. Rep. of Germany ..... 3015946

[51] Int. Cl.[3] ..... H01H 33/70

[52] U.S. Cl. ..... 200/148 A

[58] Field of Search ..... 200/148 A

[56] References Cited

U.S. PATENT DOCUMENTS 4,163,131 7/1979 Perkins ..... 200/148 A 4,237,356 12/1980 Ragaller ..... 200/148 A 4,342,890 8/1982 Graf ..... 200/148 A

*Primary Examiner*—Robert S. Macon

*Attorney, Agent, or Firm*—Burns, Doane, Swecker & Mathis

[57] ABSTRACT

A puffer piston circuit breaker has a stationary contact and a movable contact, of which at least the movable contact is tubular in shape. A piston-cylinder puffer assembly is fixedly connected with the movable contact for providing a flow of gas to extinguish the arc when the cylinder and the piston are displaced with respect to each other. In order to reduce the driving force required to actuate the moving parts to effect a flow of gas, a supplemental piston-cylinder assembly is also provided, the compression space of which is compressed by a helical spring device actuated by the current during a switching operation, such that additional quenching gas is supplied to the extinguishing flow. At least part of the current is commutated onto the spring during a switching action. The helical spring is securely clamped on one end and on the other end is fixedly connected with a movable piston of the supplemental piston-cylinder assembly. When current is flowing through the helical spring, the windings contract so that the movable piston is urged against a stationary piston member at one end of the supplemental piston-cylinder assembly.

29 Claims, 7 Drawing Figures

PUFFER PISTON CIRCUIT BREAKER

FIELD OF THE INVENTION

The present invention relates in general to "puffer piston" circuit breakers, and in particular to puffer piston circuit breakers wherein the flow of the arc quenchinq qas is augmented.

BACKGROUND OF THE INVENTION

Puffer piston circuit breakers are electrical power circuit breakers wherein the flow of quenching gas for extinguishing the electrical arc during a disconnecting action is produced simultaneously with the motion of the moving contact by a cylinder which is displaced toward a cooperating stationary piston, or vice versa, such that the space within the cylinder is reduced and the gas present therein is compressed. In the course of the continuing disconnecting motion the compressed gas is conducted to the point of contact disconnection, and thus to the electric arc, where it extinguishes the latter.

In puffer piston circuit breakers of the aforedescribed type, either the puffer piston or the puffer cylinder is driven, together with the moving contact, by an external drive which is required to supply the power neccessary to accelerate the moving masses, to overcome frictional forces and to compress the quenching gas present in the puffer cylinder. These requirements demand a high power drive, which amounts to a significant part of the overall cost of the circuit breaker.

The power required of the external drive may be reduced, while maintaining the disconnecting capacity of the circuit breaker, by obtaining at least part of the energy needed to generate the extinguishing gas flow from the arc itself. One such puffer piston power circuit breaker is disclosed in German Patent No. DE-OS 23 49 263, wherein outside the compression space of the puffer cylinder an auxiliary arc is ignited, which increases the temperature and thus also the pressure, of the gas in the combustion space, and thereby accelerates the puffer piston with an additional driving force. It is also known, for example, from French Patent No. 858,497, to generate an additional flow of gas by means of an auxiliary arc which supplements the gas flow of the puffer piston.

Both of the aforementioned prior art solutions require an auxiliary arc, which has the disadvantage of making the use of specialized contacts necessary. In addition, such contacts are also subject to burning out after a period of time in a manner similar to the principal contacts. Hence, not only the main contacts, but also the separately located auxiliary contacts, must be periodically replaced.

A further undesirable side effect of the generation of the flow of quenching gas by means of an auxiliary arc is that the quenching gas is further heated, thus reducing its quenching capacity.

SUMMARY OF THE INVENTION

These and other disadvantages of the prior art are overcome according to the present invention by providing an additional, supplemental piston-cvlinder arrangement which is actuated by the current during a disconnecting action so as to supply additional quenching gas to the arc extinguishing flow.

In accordance with one aspect of the present invention, the compression space of the supplemental piston and cylinder arrangement is compressed by means of a helical spring through which the current is at least partially commutated during a disconnecting action. In accordance with the present invention the increased gas pressure is achieved by utilizing the electromagnetic force effect of the short circuit current instead of by increasing the temperature of the quenching gas.

In accordance with a further aspect of the present invention, the helical spring advantageously is fixedly secured at one end to a stationary support member or supplemental piston, and at the other end to a movable supplemental piston of the supplemental piston-cylinder arrangement. Commutation of the current during a disconnecting action is achieved utilizing suitably disposed insulation. The magnetic force created between the individual windings of the helical spring causes the spring to contract to a greater or lesser degree as a function of the magnitude of the current. The movable supplemental piston is thereby urged by the spring toward the stationary supplemental piston, whereby the gas in the space therebetween is compressed. The compressed gas is conducted as an additional flow of gas to the arc in order to aid the main puffer flow in extinguishing the arc.

In accordance with a further aspect of the present invention, the supplemental piston-cylinder arrangement is formed by providing an outer supplemental cylinder surrounding the puffer cylinder. The helical spring and the supplemental pistons to which it is attached are located in the space between the two cylinders, which comprises the compression space of the supplemental piston cylinder arrangement. The stationary supplemental piston and the outer cylinder are mounted inside the circuit breaker in a stationary manner such that the puffer cylinder is displaceable relative to the outer cylinder in the disconnecting and connecting directions. The puffer cylinder advantageously is covered over that portion of its area which is in sliding contact with the stationary supplemental piston during the disconnecting motion with an insulating layer, the length of which in the axial direction is such that an electrically conducting connection exists in the connected state between the puffer cylinder and the stationary supplemental piston, and such that the connection is interrupted either at the onset of the disconnecting motion or no later than the time the puffer cylinder has become free of the stationary circuit breaker contact assembly.

In accordance with a still further aspect of the present invention, the supplemental cylinder is fixedly connected with the puffer cylinder. In this arrangement, the puffer cylinder advantageously has electrically conductive end regions, while the area between the supplemental pistons of the supplemental piston-cylinder arrangement is electrically insulative. The stationary supplemental piston advantageously is disposed in the vicinity where the circuit breaker contacts break connection and is provided with a check valve which allows the supplemental quenching gas to flow only toward the arc.

In order to assure commutation of the current onto the helical spring in the disconnected state of the circuit breaker, the stationary supplemental piston advantageously is fixedly connected with the outer cylinder by means of an intermediate electrically insulating layer, and the movable supplemental piston is connected with the outer cylinder by means of an electrically conducting contact layer.

In order to refill the compression space of the supplemental piston-cylinder assembly in the connected state following a disconnection, the movable supplemental piston advantageously is also provided with a check valve which permits flow of quenching gas only toward the contact break area. In accordance with a still further aspect of the present invention, optimum commutation of the short circuit current from the conducting path in the connected state to the helical spring is obtained by covering at least one of the circumferential surfaces of the puffer piston with a conductive layer and by making only part of the moving contact conductive.

In accordance with another aspect of the present invention, the helical spring advantageously is mounted to the supplemental pistons by providing the pistons with a plurality of helical grooves which receive the individual windings of the helical spring. Alternatively, individual windings of the helical spring advantageously are fastened to the supplemental pistons by means of clamps.

In accordance with still another aspect of the present invention, the helical spring advantageously has a circular cross section, but may have a differently shaped cross-section, such as, for example, a rectangular cross-section. The helical spring advantageously is made of spring steel or has a spring steel core and an applied layer of a metal with a higher electrical conductivity. Advantageously, the free windings which are not mounted to the supplemental pistons are also provided with an electrically insulating layer.

In accordance with an additional aspect of the present invention, the helical spring is wound at a constant pitch and the winding cross-section of the helical spring is also constant. It is also advantageous to wind the helical spring with a variable pitch and to vary the winding cross-section of the helical spring in order to accomodate the variation in contracting force which has been found to be generated over the length of the spring. By dimensioning the winding cross-section and the pitch, respectively, to accomodate the relatively greater contracting forces which exist at the ends of the spring than in the middle area, a favorable stressing of the helical spring may be obtained, whereby a simultaneous uniform contraction or the windings is assured.

These and other features and advantages of the present invention will be set forth in, or apparent from, the following detailed description of preferred embodiments.

BRIEF DESCRIPTION OF THE DRAWINGS

The preferred embodiments will be described with reference to the accompanying Figures.

DETAILED DESCRIPTION OF THE PREFERRED EMBODIMENTS

Figure 1:
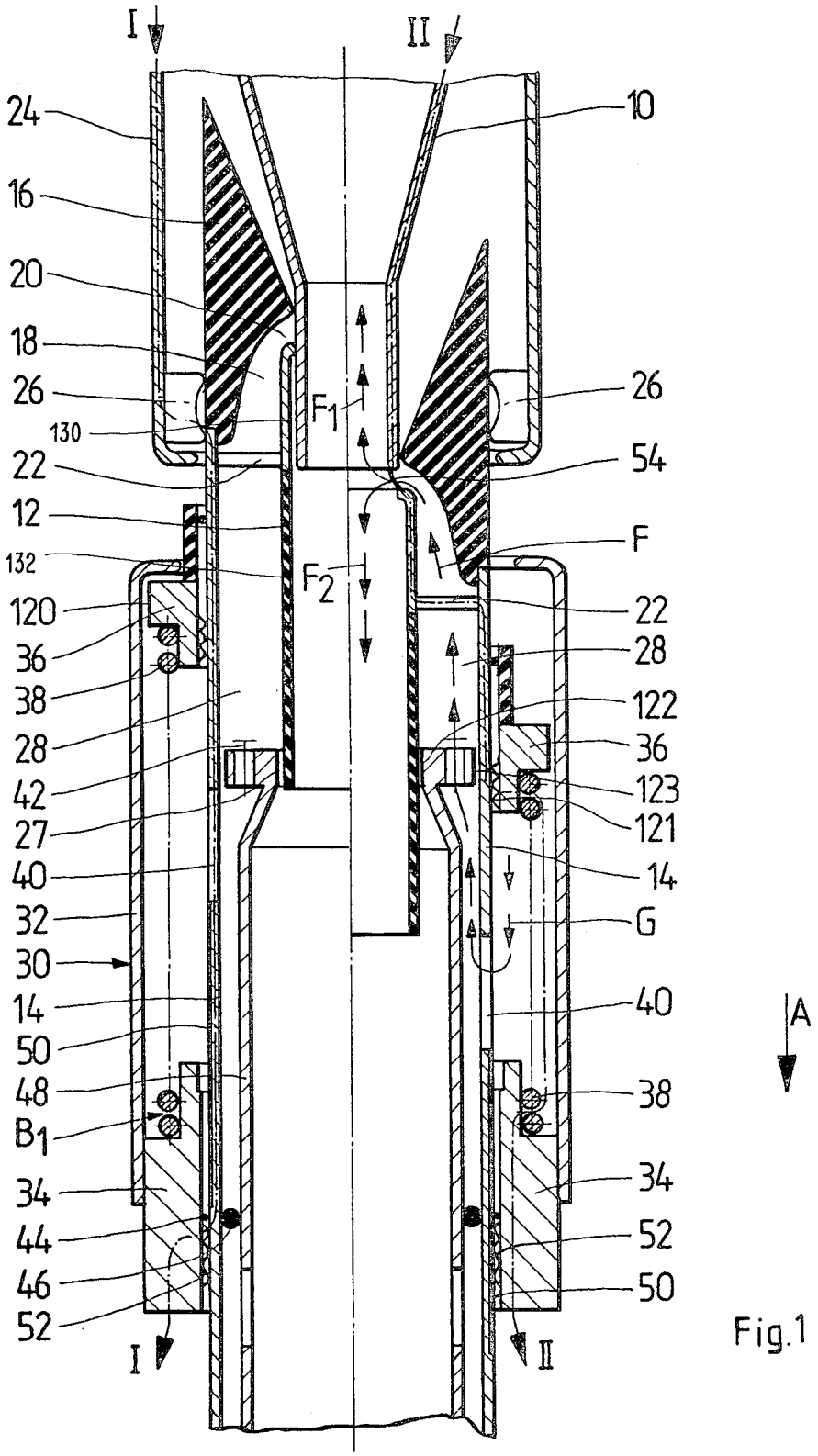
FIG. 1 is a schematic axial cross-sectional view of a first embodiment of a puffer piston power circuit breaker constructed in accordance with the present invention, wherein to the left of the center line the circuit breaker is represented in the connected state thereof and to the right of the center line the circuit breaker is represented in an intermediate position thereof during disconnection.
Figure 2:
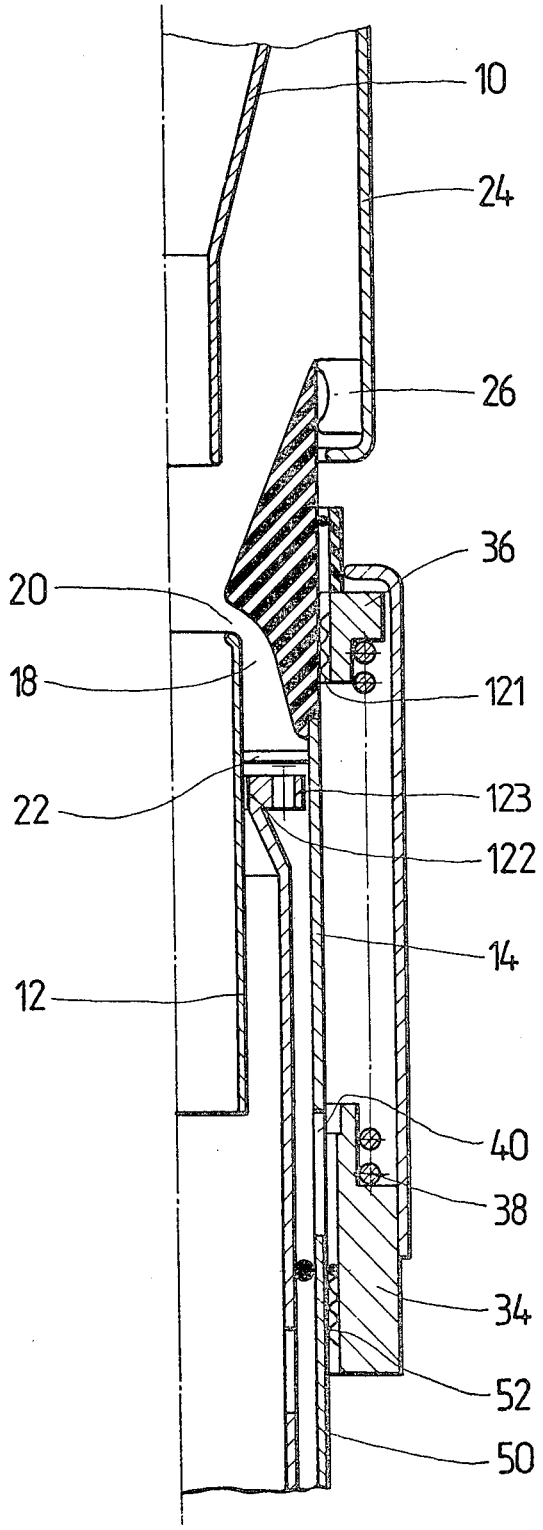
FIG. 2 is a schematic partial axial cross-section of the puffer piston circuit breaker shown in FIG. 1 with the circuit breaker in the disconnected state thereof.

Referring to FIGS. 1 and 2, a first embodiment of a puffer piston power circuit breaker constructed according to the present invention comprises a tubular stationary contact 10, which acts in cooperation with a similarly tubular, coaxially disposed movable contact 12 which is connected to conventional drive means (not shown). As will be appreciated by those of ordinary skill in the art, the circuit breaker further comprises a sealed housing (not shown) in which the various elements are disposed in a quenching gas atmosphere. As shown, movable contact 12 overlaps stationary contact 10 in the connected state of the circuit breaker, whereby a precompression of the quenching gas is effected. A puffer cylinder 14 concentrically surrounds and is fixedly connected with movable contact 12. Cylinder 14 is equipped at the distal end thereof with a blow nozzle 16 made of an insulating material which is disposed adjacent the end of movable contact 12 at which the arc is ignited durinq a disconnecting action. As shown particularly in FIG. 2, blow nozzle 16 and the end of movable contact 12 form an annular channel 18 which terminates in an annular, radial clearance 20. Puffer cylinder 14 advantageously is fixedly joined with movable contact 12 by means of holding straps 22, so that puffer cylinder 14 and nozzle 16 are displaced together with contact 12 during a disconnecting movement of contact 12, as is shown in the right half of FIG. 1 and in FIG. 2. Advantageously, as shown in FIG. 1, movable contact 12 has an electrically conducting region 130 providing an electrical connection between the end thereof which contacts stationary contact 10 and straps 22, and an electrically insulating region 132 extending beyond the junction of straps 22 with contact 12 to the opposite end of contact 12. A current supply cylinder 24, which may be provided with slits (not shown), is disposed so as to partially overlap puffer cylinder 14 when cylinder 14 is disposed with contacts 10 and 12 in the full contact quiescent position thereof, such that cylinder 24 conducts the current in the quiescent state of the circuit breaker to puffer cylinder 14. Contact fingers 26 advantageously are provided, as shown, to electrically connect current supply cylinder 24 with puffer cylinder 14.

The circuit breaker of FIGS. 1 and 2 further comprises a stationary, annular puffer piston 27 which is supported in place by a supporting tube 48 fixedly mounted within the circuit breaker, and the central opening of which slidingly receives movable contact 12. Puffer piston 27 and cylinder 14 define, together with nozzle 16 and movable contact 12, a compression space 28. Puffer cylinder 14 cooperates with puffer piston 27 so that during a switching or disconnect operation of the circuit breaker, space 28 is reduced in size, thereby compressing the quenching gas present therein. Puffer piston 27 advantageously is provided with insulating layers 122 and 123 on its inner and outer circumferences, respectively, in order to insulate it electrically from movable contact 12 and puffer cylinder 14, respectively.

A supplemental piston-cylinder assembly, qenerally denoted 30, is arranged concentrically around puffer cylinder 14, and comprises a stationary supplemental cylinder 32 which is fixedly mounted within the circuit breaker in a conventional manner (not shown) and is spaced from and surrounds cylinder 14. Assembly 30 further comprises a stationary support member or supplemental piston 34 and a movable supplemental piston 36 located in the space between cylinders 32 and 14. As shown, supplemental pistons 34 and 36 are axially spaced from each other, with stationary supplemental piston 36 fixedly connected to supplemental cylinder 32. Movable piston 36 is provided with an insulating layer 120 on the external circumferential surface thereof to electrically insulate piston 36 from supplemental cylinder 32.

Figure 5:
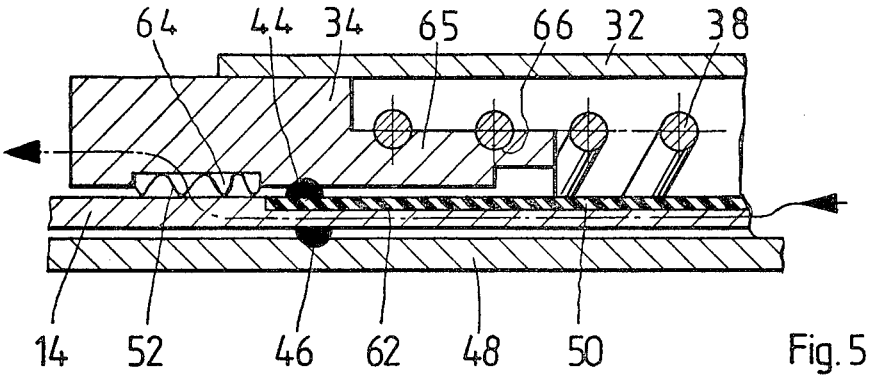
FIG. 5 is an enlarged detailed view of a portion of the circuit breaker embodiment shown in FIG. 1.
Figure 6:
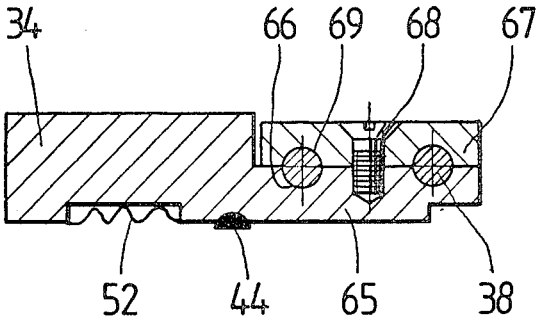
FIG. 6 is an enlarged detailed view of a further embodiment of the portion of the circuit breaker embodiment shown in FIG. 5.

Pistons 34 and 36 are connected by an intermediate helical spring 38 located in the space between cylinders 32 and 14. The respective ends of spring 38 are fixedly connected to the corresponding pistons 34 and 36. As shown in FIG. 5 with respect to piston 34, pistons 34 and 36 advantageously are each provided with a cylindrical extension 65 having helical grooves 66 on the outer circumference thereof which are adapted to receive individual windings of spring 38. As shown in FIG. 6, clamping elements 67 advantageously are also provided. Clamping elements 67 are formed with grooves 69 in one surface thereof which mate with the windings of spring 38 which are seated in grooves 66 on cylindrical extension 65. Elements 67 advantageously are joined to pistons 34 and 36 by means of bolts 68. It will be appreciated by those of ordinary skill in the art that spring 38 may also be fastened to pistons 34 and 36 by means of a weld joint or the like.

Figure 7:
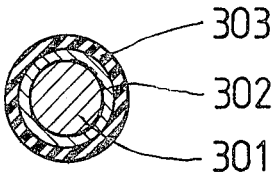
FIG. 7 is a cross-sectional view of one embodiment of a helical spring utilized in a puffer piston power circuit breaker constructed in accordance with the present invention.

Helical spring 38 advantageously is in the form of a cylindrical helical spring with a circular wire cross-section. However, it will be appreciated that the windings may be formed of wire having a different configuration, such as, for example, a rectangular cross-section. Furthermore, in order to optimize the mechanical stress on the spring, spring 38 advantageously is shaped with a variable pitch or with a wire cross-section which varies per winding. The spring windings located freely in the gas space between the supplemental pistons 34 and 36, i.e., the spring windings not fastened to the two pistons, are provided on the wire surface with an insulating layer in order to prevent the short-circuiting of adjacent windings when spring 38 is contracted. To increase its current carrying capacity, spring 38 advantageously is made from a combination of a high strenqth spring steel with a low electrical conductivity and a material with a high electrical conductivity, for example, copper. An illustrative spring construction is shown in FIG. 7 and comprises a layer 302 of copper which is applied to a wire core 301 of a spring steel with high mechanical strength. Over copper layer 302 there is an electrically insulating layer 303 which electrically insulates the individual windings when they are in contact with each other.

A passage 40 is formed in puffer cylinder 14 at a location corresponding to the point of furthest displacement toward supplemental piston 34 of which supplemental piston 36 is capable. Passage 40 communicates with puffer compression space 28 by means of a check valve 42 located in puffer piston 27. Check valve 42 permits the flow of quenching gas only into space 28 and prevents flow out therefrom.

Referring in particular to the detailed view of FIG. 5, a first gasket 44 is provided in the vicinity of supplemental piston 34 and between piston 34 and the outer wall of puffer cylinder 14. A second gasket 46 is provided between puffer cylinder 14 and the external surface of puffer piston supporting tube 48 which cooperates with first gasket 44 to provide gas seals which prevent gas flow from supplemental piston-cylinder assembly 30 except through passage 40 and check valve 42. Between supplemental piston 34 and puffer cylinder 14, an insulating layer 50 is fixedly joined to cylinder 14 and is axially offset from a convoluted contact plate 52 which is mounted on the opposing face of stationary supplemental piston 34. Puffer cylinder 14 is provided with a recess 62 that accomodates layer 50 and an offset 64 is provided in supplemental piston 34 that accomodates contact plate 52. The dimensions of layer 50 and the axial offset between layer 50 and plate 52 are such that (a) an electrical connection between puffer cylinder 14 and supplemental piston 34 is provided through plate 52 when the circuit breaker is in the connected state, as shown in the left half of FIG. 1, which allows the current flow, as indicated by the dot-and-dash line I, from current supply cylinder 24 through contact fingers 26 to cylinder 14, from cylinder 14 through contact plate 52 to supplemental piston 34, and from there to further conventional outlet contact elements (not shown); and (b) this electrical path is effectively broken in the disconnected state of the circuit breaker, or beyond a predetermined point during a disconnecting action, as insulating layer 50 is displaced into overlying relationship with plate 52, and the resistance of the current path through the plate 52 increases to the point where the current path commutates to spring 38. It will be appreciated that insulating layers 122 and 123 on puffer piston 27 prevent current from flowing through movable contact 12 or puffer cylinder 14 to supplemental piston 26. Movable supplemental piston 36 advantageously also is provided with a contact plate 121 abutting puffer cylinder 14.

During a disconnecting action, as shown in the right half of FIG. 1, movable contact 12 moves in the direction of arrow A. As soon as contact fingers 26 no longer touch the moving puffer cylinder 14, and insulating layer 50 covers contact plate 52 connected to supplemental piston 34, the current flows over the path indicated by the broken line II; i.e., the current flows as an arc 54 from stationary contact 10 to movable contact 12, then through holding straps 22 to puffer cylinder 14, from cylinder 14 through contact plate 121 connected to supplemental piston 36, then through piston 36 and spring 38 to supplemental piston 34, from which the current then flows to the further contact elements (not shown).

During the disconnect operation the flow of quenching gas is as follows. The quenching gas compressed in space 28 flows initially in the direction denoted by arrow F through annular clearance 20, where it is divided into partial flows, denoted by the arrows F1 and F2. Spring 38 is compressed as a result of the flow of the electrical current therethrough, which causes the windings to be attracted to each other until the windings are resting upon each other in the manner of a block. Movable supplemental piston 36 is thereby also urged in the direction of arrow A. The space between supplemental pistons 34 and 36 is thus reduced in size, which compresses the quenching gas therein and causes it to flow in the direction of arrow G, through the passage 40 in puffer cylinder 14, into the annular clearance formed between puffer cylinder 14 and supporting tube 48, and then through check valve 42, which opens under the pressure of this flow, into space 28. There the supplemental flow of quenching gas combines with and adds to the flow produced by compression of space 28. Following the extinction of arc 54, helical spring 38 is without current and supplemental piston 36 thus returns to its initial rest position as a result of the mechanical spring force of spring 38.

The additional gas flow produced by supplemental piston-cylinder assembly 30 provides several important advantages. The pressure of the flow through annular clearance 20 is increased. Further, the pressure increases proportionally with increases in the current flow because of the current-dependent force effect of the helical spring. Thus, the greater is the intensity of the arc, the greater is the pressure of the extinguishing gas flow. Moreover, depending on the dimensions of blow nozzle 16 and annular channel 18, the duration of the quenching action can be prolonged by the supplemental gas flow.

Figure 3:
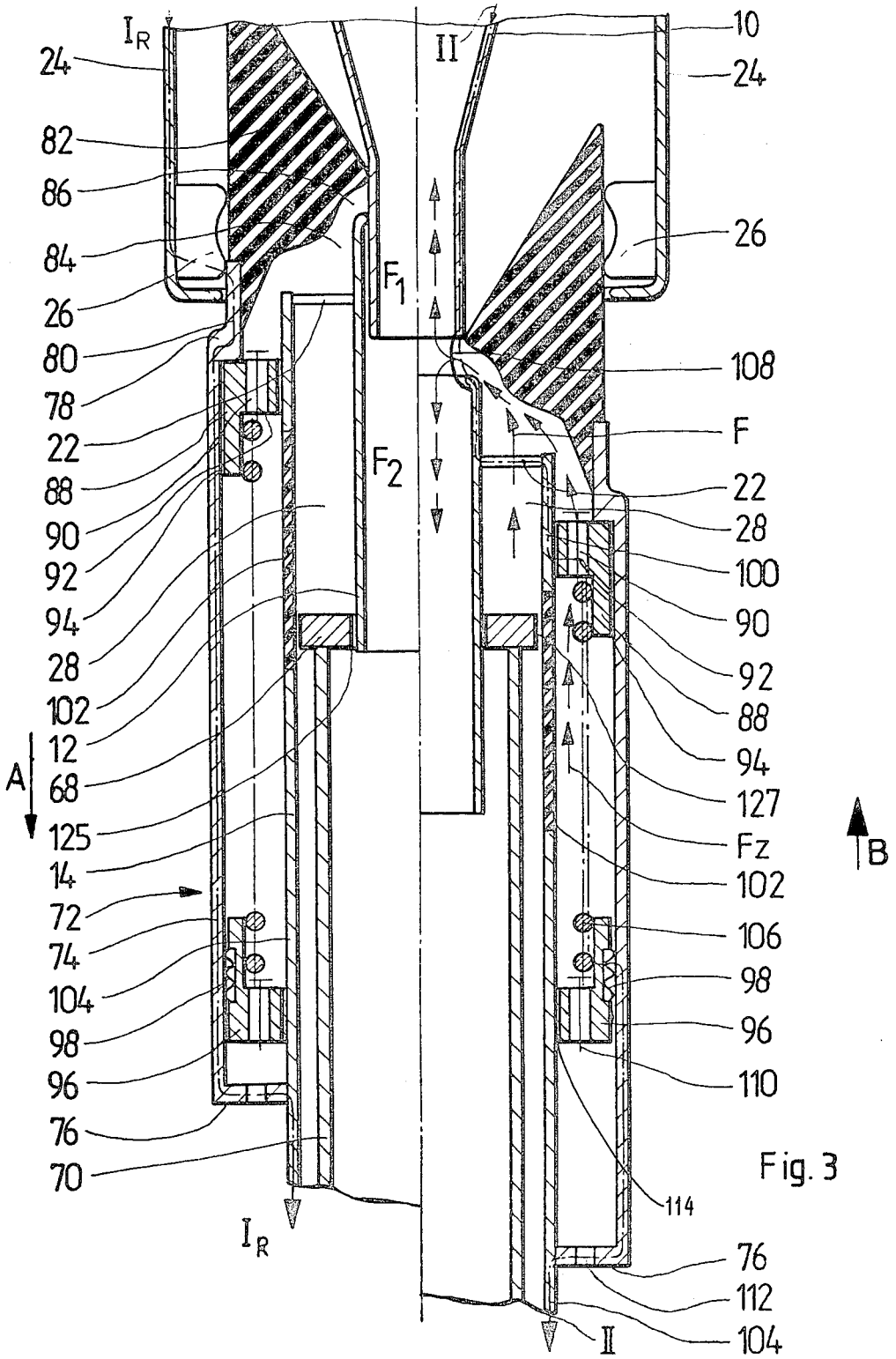
FIG. 3 is a schematic axial cross-sectional view of a second embodiment of a puffer piston power circuit breaker constructed in accordance with the present invention, wherein to the left of the center line the circuit breaker is represented in the connected state thereof and to the right of the center line the circuit breaker is represented in an intermediate position thereof during disconnection.
Figure 4:
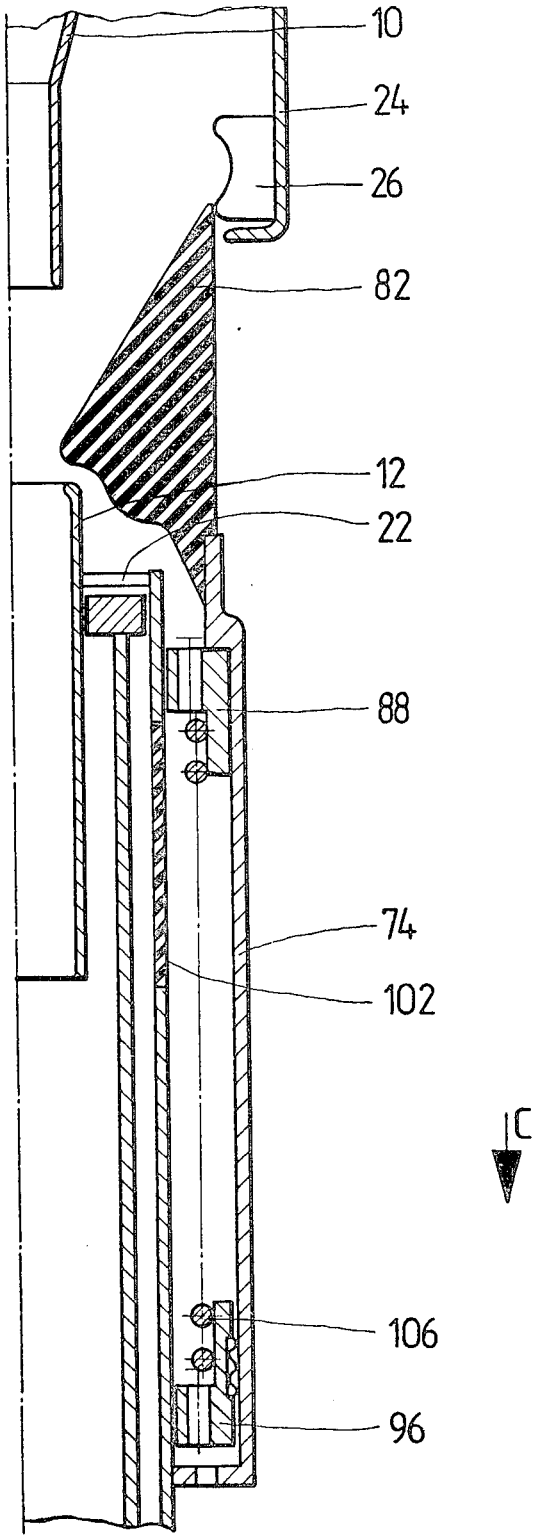
FIG. 4 is a schematic partial axial cross-sectional view of the circuit breaker embodiment shown in FIG. 3 with the circuit breaker in the disconnected position thereof.

A second embodiment of a puffer piston power circuit breaker constructed in accordance with the present invention, which also utilizes the same principle of a current actuated supplemental piston-cylinder assembly, is illustrated in FIGS. 3 and 4 and comprises a stationary, tubular contact 10 which cooperates with an overlapping movable contact 12. Contact 12 overlaps stationary contact 10 in order to obtain precompression. A puffer cylinder 14 is connected to movable contact 12 by means of holding or mounting straps 22 such that cylinder 14 and movable contact 12 are displaced together in the direction of arrow A during a disconnecting action of the circuit breaker. The circuit breaker is further equipped with a stationary puffer piston 68 mounted in place by a supporting tube 70 corresponding to tube 48 of FIG. 1. In contrast to the stationary piston 27 shown in FIG. 1, piston 68 is not provided with a check valve. However, like piston 27, puffer piston 68 is provided with an insulating layer 125 on its inner circumference to insulate it electrically from movable contact 12.

An additional or supplemental piston-cylinder assembly 72 is formed by an outer supplemental cylinder 74 spaced from and concentrically disposed around puffer cylinder 14. Cylinder 74 is fastened to puffer cylinder 14 at a location thereon which is axially spaced from the end proximate the region in which contacts 10 and 12 break connection, preferably by welding the distal end of an inwardly projecting flange 76 which forms the bottom of cylinder 74 to cylinder 14. The opposite end of supplemental cylinder 74, i.e., the end proximate the contact connection breaking area, is constricted and terminates in a nose 80 to which a blow nozzle 82 corresponding to nozzle 16 in FIGS. 1 and 2 is fastened. Nozzle 82 forms with movable contact 12 an inlet channel 84 terminating in an annular clearance 86 corresponding to annular clearance 20 of FIG. 1. A current supply cylinder 24 is disposed similarly to the embodiment of FIG. 1 so as to surround the contact disconnection area and to carry the current in the quiescent state of the circuit breaker. However, in contrast to the arrangement of FIG. 1, current supply cylinder 24 is disposed such that the current flow in the connected state of the circuit breaker is not directly through puffer cylinder 14, but initially through supplemental cylinder 74. Advantageously, the arrangement is such that, as denoted by arrow $I_R$, current flows from supply cylinder 74 through contact fingers 26, as in the case of the first embodiment, to nose 80 of cylinder 74, through the body of cylinder 74, and to puffer cylinder 14 via supplemental cylinder flange 76. From cylinder 14 the current flows to further conventional outlet connections (not shown).

In the annular space between puffer cylinder 14 and supplemental cylinder 74 are disposed a stationary support member or supplemental piston 88 and an axially displaceable supplemental piston 96 which are connected by an intermediate helical spring 106 having one end thereof fixedly connected to piston 88 and the other end thereof fixedly connected to piston 96.

As shown, stationary supplemental piston 88 is disposed relatively proximate the contact disconnection area and is fixedly mounted to cylinders 14 and 74. Piston 88 is further provided with a passage therethrough and a check valve 92 located in the passage which permits flow of quenching gas from the compression space defined by cylinders 14 and 74 and by pistons 88 and 96 toward internal channel 84 and annular clearance 86. Stationary supplemental piston 88 is electrically insulated from supplemental cylinder 74 by an intermediate insulating layer 94. Movable supplemental piston 96 is electrically connected with supplemental cylinder 74 during its back and forth sliding motion by means of a contact plate 98, and the inner surface of supplemental piston 96 is provided with an insulating layer 114.

Puffer cylinder 14 advantageously is electrically conductive at each end in regions 100 and 104 thereof which are, respectively, adjacent the contact disconnection area and the location at which flange 76 of cylinder 74 is connected; and is electrically insulative in an intermediate region 102 located between supplemental piston 88 and the rest position of supplemental piston 96. Advantageously, region 102 is dimensioned such that no current can flow through region 100 to piston 68 during a disconnect operation. Such current flow advantageously also is prevented by providing an insulting layer 127 on the outer circumference of piston 68.

During a disconnecting action, movable contact 12 is displaced, together with puffer cylinder 14 and outer supplemental cylinder 74, in the direction of arrow A. When nose projection 80 of cylinder 74 is free of contact fingers 26, a flow of current is obtained, as is indicated by broken line II, from stationary contact 10 to movable contact 12. As will be appreciated by those of ordinary skill in the art, the flow is directly from contact 10 to contact 12 while the latter is still in contact with stationary contact 10 and is as an arc 108 after the contact therebetween has been broken. The current further flows through holding straps 22 to area 100 of puffer cylinder 14 and from there to supplemental piston 88. The current then proceeds through helical spring 106 to movable supplemental piston 96 and from there through piston contact plate 98 to supplemental cylinder 74. The current then flows through flange 76 to electrically conducting area 104 of puffer cylinder 14 and then to outlet contacts (not shown). As will be appreciated by those of ordinary skill in the art, insulating layer 125 applied to the inner circumference of puffer piston 68 prevents the flow of current through movable contact 12, piston 68 and support tubes 70 to the outlet contacts.

By virtue of the flow of current through helical spring 106, adjacent windings are contracted under the effect of the magnetic field generated by the current so that supplemental piston 96 is displaced in the direction opposite to arrow A, i.e., in the direction of arrow B, whereby the space between supplemental pistons 88 and 96 is reduced in size. During a disconnecting action, space 28 between contact 12 and cylinder 14 is also reduced, so that a flow of gas in the direction of arrow F toward annular clearance 86 is generated. The flow divides at clearance 86 into the flows denoted by arrows $F_1$ and $F_2$. The supplemental flow of the gas coming from the space between puffer cylinder 14 and supplemental cylinder 74, which is denoted by the arrow $F_z$, is superposed on the flow from space 28. As in the case of the embodiment of FIGS. 1 and 2, the supplemental flow of gas enhances the overall flow acting to extinguish the arc, and, depending on the dimensions of blow nozzle 82 and annular clearance 86, may extend the extinguishing flow.

Check valve 92 in passage 90 permits the flow of gas only from the space between cylinders 14 and 74 toward blow nozzle 82. Valve 92 opens necessarily whenever the pressure in the space between cylinders 14 and 74 is higher than the pressure in space 28. No reverse flow, potentially leading to a contamination or ineffectiveness of the supplemental cylinder assembly, is possible.

It is advantageous to also provide a corresponding check valve 110 in movable supplemental piston 96. Check valve 110 opens when piston 96 arrives in its rest position, so that the space between the two supplemental pistons 88 and 96 may again be filled with quenching gas. Check valve 110 permits the flow of gas only in the space between the two pistons 88 and 96. In order to prevent the generation of reduced pressure in the space between supplemental cylinder flange 76 and supplemental piston 96, which potentially could counteract the effect of spring 106, an orifice 112 advantageously is provided in flange 76, as shown. A similar layout advantageously is provided in the embodiment of FIG. 1 as well, wherein a check valve (not shown) may be inserted either in stationary supplemental piston 34 or in movable supplemental piston 36, so that only the entry of quenching gas in the space between puffer cylinder 14 and supplemental cylinder 32 is possible. As shown in FIG. 4, following the extinction of arc 108, helical spring 106 is without current and supplemental piston 96 is returned by the mechanical spring force of spring 106 to its initial rest position.

It will be appreciated by those of ordinary skill in the art that the present invention is not restricted to the preferred embodiments disclosed herein, and that changes and modifications may be made without departing from the scope or spirit of the invention.

What is claimed is:

1. A puffer piston circuit breaker having a stationary and a movable contact, at least one of which is tubular in form, and a piston-cylinder puffer assembly fixedly connected with the movable contact such that there is relative displacement of the puffer piston and cylinder toward each other during a disconnecting action to obtain a flow of quenching gas for extinguishing the electrical arc created during the disconnecting action, wherein the improvement comprises a supplemental piston-cylinder assembly which defines a compression space, and means actuated by the current during the disconnecting action for causinq said supplemental piston-cylinder assembly to compress said compression space and thereby provide additional quenching gas to said flow of quenching gas.

2. The puffer piston circuit breaker of claim 1 wherein said supplemental piston-cylinder assembly comprises a movable supplemental piston and said current-actuated means comprises helical spring means through which the current is at least partially commutated during a disconnecting action, said spring means being fixedly mounted at a first end thereof and being fixedly joined at a second end thereof to said movable piston.

3. The puffer piston circuit breaker of claim 2 wherein said puffer piston is stationary and said puffer cylinder is movable, and said supplemental piston-cylinder assembly comprises an outer supplemental cylinder surrounding said puffer cylinder in spaced relationship therewith, and said compression space is located between said puffer and said supplemental cylinders.

4. The puffer piston circuit breaker of claims 2 or 3 wherein said puffer cylinder is connected with said movable contact so as to move therewith in the connecting and disconnecting directions, said supplemental piston-cylinder assembly further comprises a stationary supplemental piston fixedly mounted within the circuit breaker and to which said helical spring first end is fastened, and said supplemental cylinder is fixedly mounted within the circuit breaker such that said puffer cylinder is movable relative to said supplemental cylinder.

5. The puffer piston circuit breaker of claim 4 wherein said puffer cylinder is covered over an area in sliding relationship with said stationary supplemental piston durinq the disconnecting action such that in a quiescent connected state of the circuit breaker an electrical connection exists between said puffer cylinder and said stationary supplemental piston and such that said electrical connection is interrupted either upon initiation of the disconnecting action or at a point during the disconnecting action no later than the point at which said movable contact has become disconnected from said stationary contact.

6. The puffer piston circuit breaker of claims 1 or 2 wherein said puffer piston is stationary and said puffer cylinder is movable and said supplemental piston-cylinder assembly comprises an outer supplemental cylinder surrounding said puffer cylinder and fixedly joined to said puffer cylinder so as to define a compression space therebetween.

7. The puffer piston circuit breaker of claim 6 wherein said supplemental piston-cylinder assembly further comprises a stationary supplemental piston fixedly mounted within said supplemental cylinder and to which said helical spring first end is fastened, and said puffer cylinder has first and second electrically conducting end regions and an electrically insulating intermediate region located between the positions of said supplemental pistons.

8. The puffer piston circuit breaker of claim 7 wherein said stationary supplemental piston is disposed relatively adjacent the area in which said stationary and movable contacts disconnect during the disconnecting action, and is fixedly joined via an electrically insulating layer with said supplemental cylinder.

9. The puffer piston circuit breaker of claim 8 wherein said movable supplemental piston is electrically and slidingly connected with said supplemental cylinder by means of a contact layer.

10. The puffer piston circuit breaker of claim 9 wherein a check valve is provided in said stationary supplemental piston and in said movable supplemental piston, said check valves permitting the flow of gas only toward the area of contact disconnection.

11. The puffer piston circuit breaker of any one of claims 1 to 5, wherein a check valve is provided in said puffer piston, said check valve permitting the flow of gas only toward the area in which said contacts disconnect.

12. The puffer piston circuit breaker of claim 1 wherein said puffer piston is annularly shaped and is covered on at least one of its two circumferential surfaces with an electrically conducting material.

13. The puffer piston circuit breaker according to claim 1 wherein said puffer cylinder is connected to said movable contact by at least one strap and said movable contact comprises an electrically conducting region providing an electrical connection between a first end thereof which contacts said stationary contact and said at least one strap, and an electrically insulating region extending between the at least one location at which said at least one strap is joined to said movable cylinder and the end thereof which is opposite to said first end.

14. A puffer piston circuit breaker according to claim 4 wherein said supplemental pistons are each provided with helical grooves therein which receive individual windings of said helical spring for providing a fixed connection between said spring and each of said supplemental pistons.

15. A puffer piston circuit breaker according to claim 4 wherein individual windings of said helical spring are fastened to said supplemental pistons by means of clamping elements.

16. A puffer piston circuit breaker according to claim 2 wherein said helical spring has a circular cross-section.

17. A puffer piston switch according to claim 2 wherein said helical spring has a rectangular wire cross-section.

18. A puffer piston switch according to claim 2 wherein the windings of said helical spring which are not connected mechanically and electrically with said supplemental pistons are provided on their exterior surfaces with an insulating layer.

19. A puffer piston circuit breaker according to claim 2 wherein said helical spring consists of spring steel.

20. A puffer piston circuit breaker according to claim 2 wherein said helical spring comprises a spring steel core and a layer of a metal with a higher electrical conductivity applied to said core.

21. A puffer piston circuit breaker according to claim 2 wherein said helical spring is wound with a constant pitch.

22. A puffer piston switch according to claim 2 wherein said helical spring is wound with a variable pitch.

23. A puffer piston circuit breaker according to claim 2 wherein the winding cross-section of said helical spring is constant.

24. A puffer piston circuit breaker according to claim 2 wherein the winding cross-section of said helical spring is variable.

25. A puffer piston circuit breaker having a stationary and a movable contact, and a piston-cylinder puffer assembly connected with said movable contact such that there is relative displacement of the puffer piston and cylinder toward each other during a disconnecting action to obtain a flow of quenching gas for extinguishing the electrical arc created during a disconnecting action, wherein the improvement comprises a supplemental piston-cylinder assembly defining a compression space which is actuated by the current during a disconnecting action to compress said compression space and thereby augment said flow of quenching gas.

26. The puffer piston circuit breaker of claim 25 wherein said supplemental piston-cylinder assembly comprises a supplemental cylinder spaced from said puffer cylinder, a movable supplemental piston disposed between said puffer cylinder and said supplemental cylinder, elongate spring means having a first end fixedly mounted with respect to said supplemental cylinder and a second end connected to said supplemental piston, and means for at least partially commutating current flow through the circuit breaker during a disconnecting action from a first path bypassing said spring means to a second path through said spring means.

27. The puffer piston circuit breaker of claim 26 wherein said puffer cylinder is connected to said movable contact for movement therewith, and said first current path includes an electrical connection between said puffer cylinder and a stationary support member to which said spring means first end is connected, and said commutating means comprises insulating means mounted on said puffer cylinder such that displacement of said puffer cylinder as a consequence of a disconnecting action causes said insulating means to interrupt said electrical connection.

28. The puffer piston circuit breaker of claim 26 wherein said supplemental cylinder is connected to said movable contact for displacement therewith, and said commutating means comprises a further stationary contact which forms an electrical connection with said supplemental cylinder which is broken by displacement of said movable contact.

29. The puffer piston circuit breaker of claim 28 wherein said second current path includes a portion of said puffer cylinder which is electrically connected with said spring means, and said commutating means further comprises an electrically insulating region of said puffer cylinder which prevents current flow directy therethrough.

* * * * *